US011130163B2

(12) United States Patent
Matsumoto

(10) Patent No.: US 11,130,163 B2
(45) Date of Patent: Sep. 28, 2021

(54) PRESS MOLDING METHOD AND PRESS MOLDING APPARATUS

(71) Applicant: MAZDA MOTOR CORPORATION, Hiroshima (JP)

(72) Inventor: Shigeru Matsumoto, Higashihiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 265 days.

(21) Appl. No.: 16/424,640

(22) Filed: May 29, 2019

(65) Prior Publication Data

US 2019/0366413 A1 Dec. 5, 2019

(30) Foreign Application Priority Data

Jun. 4, 2018 (JP) ..... JP2018-107211

(51) Int. Cl.
*B21D 28/26* (2006.01)
*B21D 28/02* (2006.01)
*B21D 22/06* (2006.01)

(52) U.S. Cl.
CPC ..... *B21D 28/26* (2013.01); *B21D 28/02* (2013.01); *B21D 22/06* (2013.01)

(58) Field of Classification Search
CPC ..... B21D 28/02; B21D 28/00; B21D 28/26; B21D 22/06; B21D 22/02; B21D 22/24; B21D 24/16
See application file for complete search history.

(56) References Cited

U.S. PATENT DOCUMENTS

2013/0228000 A1* 9/2013 Eguchi ..... B21D 37/08 72/334
2018/0185899 A1* 7/2018 Saito ..... B21D 22/22

FOREIGN PATENT DOCUMENTS

JP 6083390 B2 * 2/2017 ..... B21D 22/26
JP 6119929 B1 4/2017

OTHER PUBLICATIONS

Satoshi, Translation of JP-6083390-B2 (publication JP 2015131306) (Year: 2015).*

* cited by examiner

*Primary Examiner* — Adam J Eiseman
*Assistant Examiner* — Bobby Yeonjin Kim
(74) *Attorney, Agent, or Firm* — Studebaker & Brackett PC

(57) ABSTRACT

Disclosed herein is a press molding method for forming a press-molded product having a flange including a special-shaped portion. The method includes: a trimming step of determining an outer peripheral edge of the flange and forming the special-shaped portion; and a finishing step of molding the flange into a final product shape position of the press-molded product after the trimming step. The flange includes a first flange portion including at least a portion of an outer peripheral edge of the special-shaped portion. In the trimming step, the first flange portion is press-molded into a preform position deeper in a thickness direction of the first flange portion than a final product shape position of the first flange portion, and in the finishing step, return molding of lifting the first flange portion in the thickness direction of the first flange portion to the final product shape position of the first flange portion is performed.

4 Claims, 13 Drawing Sheets

PRESS MOLDING METHOD AND PRESS MOLDING APPARATUS

CROSS-REFERENCE TO RELATED APPLICATION

This application claims priority to Japanese Patent Application No. 2018-107211 filed on Jun. 4, 2018, the entire disclosure of which is incorporated by reference herein.

BACKGROUND

The present disclosure relates to a press molding method and a press molding apparatus.

Countermeasures have been taken against cracks generated during the formation of a special-shaped portion such as a curved portion by press molding (see, e.g., International Publication No. WO 2017/006793).

WO 2017/006793 discloses a method of manufacturing a press component. In this method, for the pressing of a blank made of an ultra-high tensile strength steel sheet by a free bending method, a material inflow facilitating portion for increasing the amount of a material flowing into a predetermined portion of the blank to be molded is formed at a predetermined position, so that no cracks are generated in a flange on an inner circumferential side of a curved portion of the press component.

SUMMARY

When a special-shaped portion such as a cutout portion is formed in a flange, the flange including the special-shaped portion may be trimmed in a first step, and then, the flange is molded into the final shape in a second step. If press molding is performed in the second step so that the periphery of a portion provided with the special-shaped portion extends, a tensile force acts on the portion with the special-shaped portion, resulting in cracking of the special-shaped portion.

In view of the foregoing, it is an object of the present disclosure to provide a press molding method and press molding apparatus capable of reducing the occurrence of cracking of a special-shaped portion, and improving moldability of a press-molded product, even in the case where the special-shaped portion is formed in a flange of a press-molded product.

To achieve the object, a first aspect of the present disclosure relates to a press molding method for forming a press-molded product having a flange including a special-shaped portion. The method including: a trimming step of determining an outer peripheral edge of the flange and forming the special-shaped portion; and a finishing step of molding the flange into a final product shape position of the press-molded product after the trimming step, wherein the flange includes a first flange portion including at least a portion of an outer peripheral edge of the special-shaped portion, in the trimming step, the first flange portion is press-molded into a preform position deeper in a thickness direction of the first flange portion than a final product shape position of the first flange portion, and in the finishing step, return molding of lifting the first flange portion in the thickness direction of the first flange portion to the final product shape position of the first flange portion is performed.

According to this aspect, in the trimming step, the first flange portion including at least a portion of the outer peripheral edge of the special-shaped portion is press-molded into the preform position of the first flange portion deeper than the final product shape position thereof, and in the finishing step, the return molding of lifting the first flange portion to the final product shape position is performed. Therefore, in the finishing step, a pressing force is applied in the direction in which the first flange portion is compressed. This can reduce the occurrence of a tensile force in the vicinity of the special-shaped portion. As a result, the occurrence of cracking in the vicinity of the special-shaped portion can be reduced, and the moldability of the press-molded product can be improved.

According to a second aspect related to the first aspect of the present disclosure, the special-shaped portion is a cutout portion having an opening at the outer peripheral edge of the flange, the flange includes the first flange portion including a portion of an outer peripheral edge of the cutout portion, and a second flange portion including another portion of the outer peripheral edge of the cutout portion, and the press-molded product in the final product shape has the first flange portion and the second flange portion extending in different directions.

When the extending direction of the first flange portion and the extending direction of the second flange portion, which form the outer peripheral edge of the cutout portion, differ from each other, the first and second flange portions are arranged to be twisted with respect to each other via the cutout portion. In this case, a tensile force may tend to be generated in the vicinity of the cutout portion in the finishing step. According to this aspect, even when the first and second flange portions are arranged in a twisted state, the occurrence of a tensile force in the vicinity of the cutout portion can be reduced. This can reduce the occurrence of cracking in the vicinity of the cutout portion, and can improve the moldability of the press-molded product.

According to a third aspect related to the second aspect of the present disclosure, in the finishing step, bending of the second flange portion is performed so that a predetermined angle is formed between the extending direction of the first flange portion and the extending direction of the second flange portion.

According to this aspect, the return molding for forming the first flange portion is performed, and the bending for forming the second flange portion is performed, thereby forming the first and second flange portions the extending directions of which form a predetermined angle therebetween. Further, the return molding for forming the first flange portion can reduce the occurrence of cracking in the vicinity of the cutout portion, thereby improving the moldability of the press-molded product.

According to a fourth aspect related to the third aspect of the present disclosure, in the finishing step, the return molding and the bending are performed in the same mold.

This can simplify the finishing step, and hence can simplify the press molding method.

A fifth aspect of the present disclosure is directed to a press molding apparatus for forming a press-molded product having a flange portion including a special-shaped portion. The apparatus includes: a trimming element which forms an outer peripheral edge of the flange and the special-shaped portion; and a finishing element which molds the flange into a final product shape position of the press-molded product, the flange of the press-molded product comprising a first flange portion including at least a portion of an outer peripheral edge of the special-shaped portion, wherein the trimming element includes: a prepressing mold which press-molds the first flange portion into a preform position deeper in a thickness direction of the first flange portion than a final product shape position of the first flange portion; and a cam member which forms the special-shaped portion, and the finishing element includes a final pressing mold which performs return molding of lifting the first flange portion in the thickness direction of the first flange portion to the final product shape position of the first flange portion.

According to this aspect, the trimming element is used to press-mold the first flange portion including at least a portion of the outer peripheral edge of the special-shaped portion into the preform position of the first flange portion deeper than the final product shape position thereof, and the finishing element is used to perform the return molding of lifting the first flange portion to the final product shape position. Therefore, in the return molding, a pressing force is applied in the direction in which the first flange portion is compressed. This can reduce the occurrence of a tensile force in the vicinity of the special-shaped portion. As a result, the occurrence of cracking in the vicinity of the special-shaped portion can be reduced, and the moldability of the press-molded product can be improved.

According to a sixth aspect related to the fifth aspect of the present disclosure, the special-shaped portion of the press-molded product is a cutout portion having an opening at the outer peripheral edge of the flange, the flange of the press-molded product includes the first flange portion including a portion of an outer peripheral edge of the cutout portion, and a second flange portion including another portion of the outer peripheral edge of the cutout portion, and the finishing element includes a bending cam member which performs bending of the second flange portion so that a predetermined angle is formed between an extending direction of the first flange portion and an extending direction of the second flange portion.

According to this aspect, the return molding for forming the first flange portion is performed, and the bending for forming the second flange portion is performed, thereby forming the first and second flange portions the extending directions of which form a predetermined angle therebetween. Further, the return molding for forming the first flange portion can reduce the occurrence of cracking in the vicinity of the cutout portion, thereby improving the moldability of the press-molded product. Further, since the finishing element includes the final pressing mold and the bending cam member, the first and second flange portions can be molded into the final product shape position in the same mold, which can contribute to the downsizing of the press molding apparatus.

According to the present disclosure described above, in the trimming step, the first flange portion including at least a portion of the outer peripheral edge of the special-shaped portion is press-molded into the preform position of the first flange portion deeper than the final product shape position thereof, and in the finishing step, the return molding of lifting the first flange portion to the final product shape position is performed. Therefore, in the finishing step, a pressing force is applied in the direction in which the first flange portion is compressed. This can reduce the occurrence of a tensile force in the vicinity of the special-shaped portion. As a result, the occurrence of cracking in the vicinity of the special-shaped portion can be reduced, and the moldability of the press-molded product can be improved.

DETAILED DESCRIPTION

Embodiments of the present disclosure will be described in detail below with reference to the accompanying drawings. The following description of the embodiments is exemplary in nature, and is not intended to limit the present disclosure, its applications, or its use.

First Embodiment

<Press-Molded Product>

Figure 1:
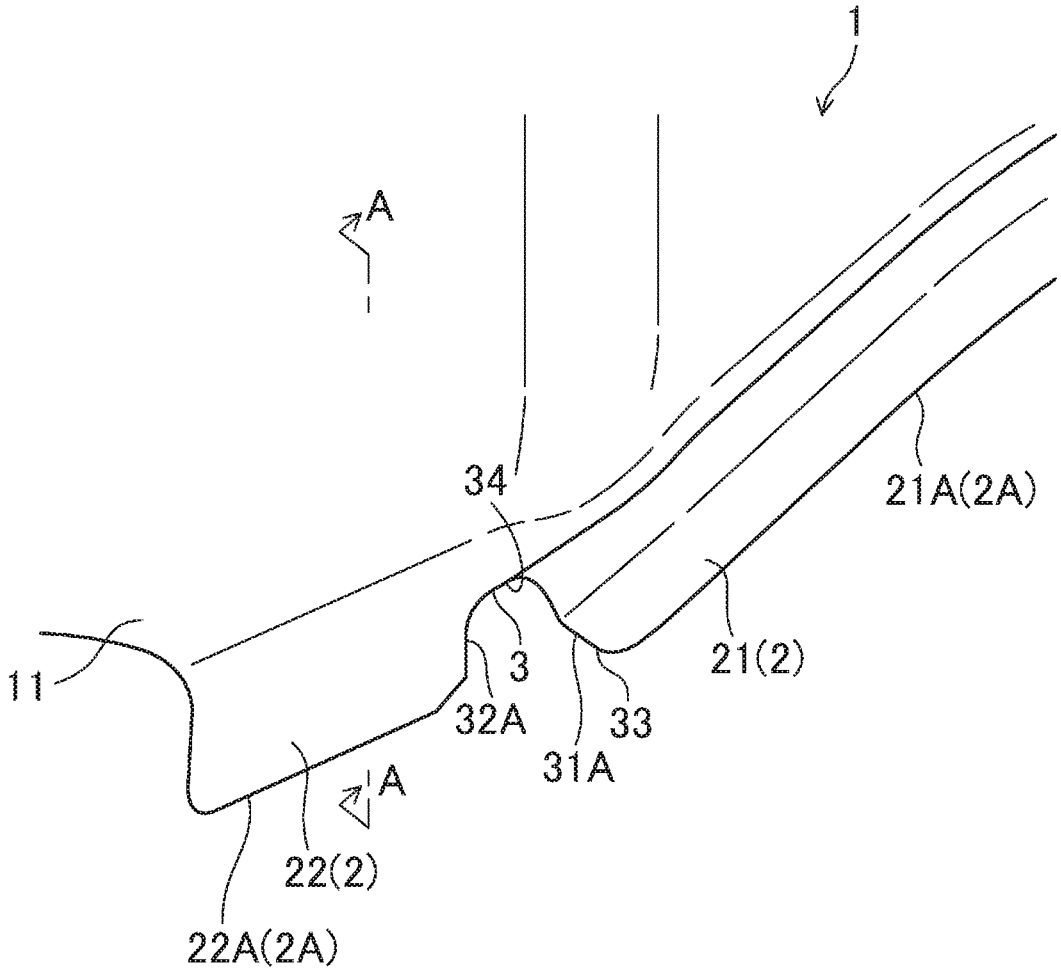
FIG. 1 is a schematic perspective view illustrating a portion of a press-molded product.
Figure 2:
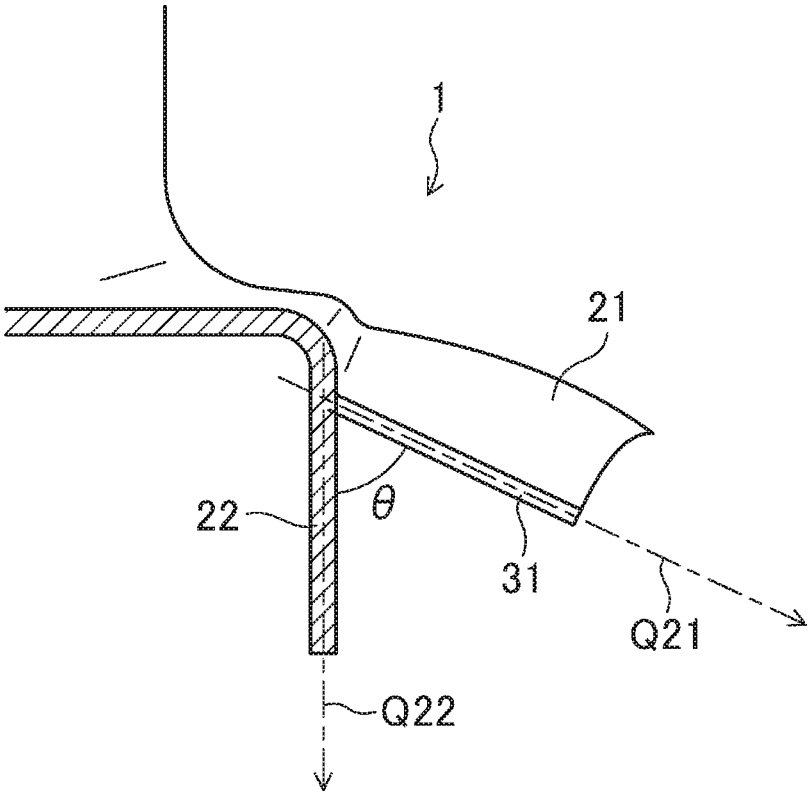
FIG. 2 is a schematic cross-sectional view taken along line A-A of FIG. 1.

FIG. 1 is a schematic perspective view illustrating a portion of the press-molded product 1. FIG. 2 is a schematic cross-sectional view taken along line A-A of FIG. 1, illustrating the press-molded product 1. FIGS. 1 and 2 show the final product shape of the press-molded product 1.

As shown in FIG. 1, the press-molded product 1 includes a press-molded product body 11, and a flange 2 formed on the outer periphery of the press-molded product body 11. The flange 2 acts as, for example, a connector for assembling the press-molded product 1 to another member with bolts or an adhesive, or by spot welding, or serves to improve the strength of the press-molded product 1.

The press-molded product 1 may be a vehicle component such as a front pillar, a center pillar, a side sill, a side member, a front frame outer panel, and a cross member. The member to which the press-molded product 1 is assembled may be a vehicle component such as a floor panel, a front panel, a rear panel, and a front frame inner panel. Examples of the material of the press-molded product 1 include iron, steel, aluminum, and alloys thereof. The press-molded product 1 is molded from a sheet material of these metals. The thickness of the sheet material is not particularly limited, and may be appropriately determined depending on the use of the press-molded product 1.

The flange 2 has a first flange portion 21, a second flange portion 22, and a cutout portion 3 which is a special-shaped portion formed between the first and second flange portions 21 and 22. The cutout portion 3 has an opening 33 which opens at an outer peripheral edge 2A of the flange 2, and extends across almost the whole width of the flange 2. The cutout portion 3 includes the opening 33, a first outer peripheral edge 31A (a portion of an outer peripheral edge of the cutout portion), a second outer peripheral edge 32A (another portion of the outer peripheral edge of the cutout portion), and a bottom 34. The first outer peripheral edge 31A, the second outer peripheral edge 32A, and the bottom 34 constitute a portion of the outer peripheral edge 2A of the flange 2.

The first flange portion 21 includes, as a portion of the outer peripheral edge 2A of the flange 2, a first flange's outer peripheral edge 21A and the cutout portion 3. The second flange portion 22 includes, as a portion of the outer peripheral edge 2A of the flange 2, a second flange's outer peripheral edge 22A and the second outer peripheral edge 32A of the cutout portion 3.

The size of the cutout portion 3 is not particularly limited, and is appropriately determined in accordance with the purpose of forming the cutout portion 3. For example, the width of the bottom 34, i.e., the length of the bottom 34 in the longitudinal direction of the flange 2, can be about 2 mm to 10 mm.

As shown in FIG. 2, an extending direction Q21 of the first flange portion 21 and an extending direction Q22 of the second flange portion 22 differ from each other, and a predetermined angle θ is formed therebetween.

For example, the press-molded product 1 can be assembled to a different member via the first flange portion 21, and to another different member via the second flange portion 22. The angle θ formed between the extending direction Q21 of the first flange portion 21 and the extending direction Q22 of the second flange portion 22 may be appropriately determined in accordance with the positional relationship with the different members to be assembled, and may be, for example, about 20° to 120°. In other words, it can be said that the first flange portion 21 and the second flange portion 22 are arranged to be twisted with respect to each other by the angle θ via the cutout portion 3.

<Press Molding Method and Press Molding Apparatus>

Figure 3:
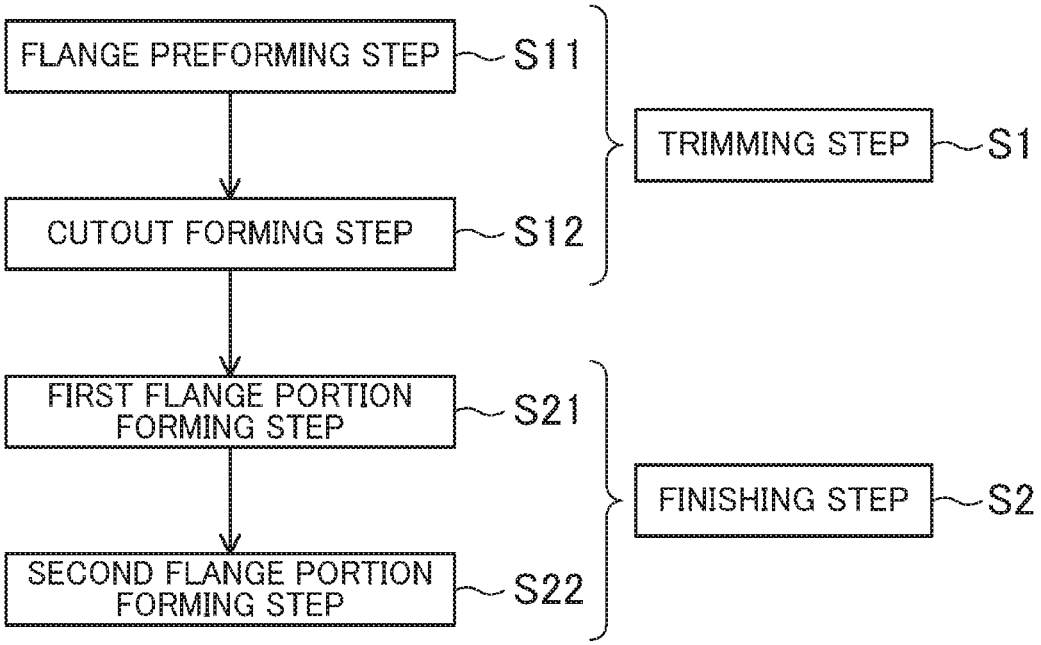
FIG. 3 is a flowchart illustrating a press molding method according to an embodiment.

FIG. 3 shows the steps of a press molding method according to the present embodiment. The press molding method of the present embodiment includes a trimming step S1 and a finishing step S2. The trimming step S1 includes a flange preforming step S11 and a cutout forming step S12. The finishing step S2 includes a first flange portion forming step S21 and a second flange portion forming step S22.

Figure 4:
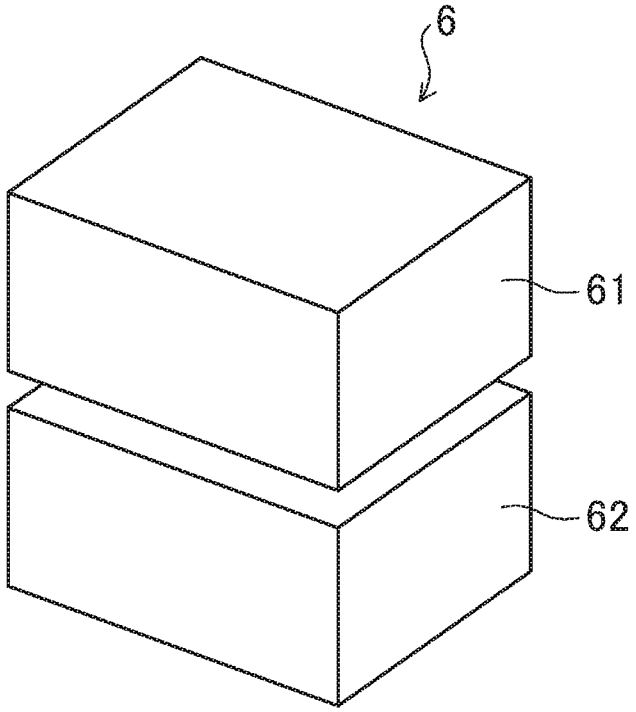
FIG. 4 is a schematic perspective view illustrating a press molding apparatus according to an embodiment.

FIG. 4 shows an example of a press molding apparatus 6 for press molding by the press molding method of the present embodiment. The press molding apparatus 6 includes an upper mold 61 and a lower mold 62. Although not shown in the drawings, molding surfaces for the press molding are formed on the mating surfaces of the upper mold 61 and the lower mold 62. As the molding surface, the upper mold 61 includes a first upper mold 61A (trimming element), a second upper mold 61B (trimming element), and a third upper mold 61C (finishing element), which will be described later, and the lower mold 62 includes a first lower mold 62A (trimming element), a second lower mold 62B (trimming element), and a third lower mold 62C (finishing element), which will be described later.

The steps will be described below.

—Trimming Step—

In the trimming step S1, the outer peripheral edge 2A of the flange 2 including the cutout portion 3, i.e., the first flange's outer peripheral edge 21A, the second flange's outer peripheral edge 22A, and the cutout portion 3, are formed. In other words, the trimming step S1 is a step of preforming a workpiece 1' before the molding, thereby giving outer shapes to a portion to be the flange 2 and a portion to be the cutout portion 3. As described above, the trimming step S1 includes the flange preforming step S11 and the cutout forming step S12 as shown in FIG. 3.

—Flange Preforming Step—

Figure 5:
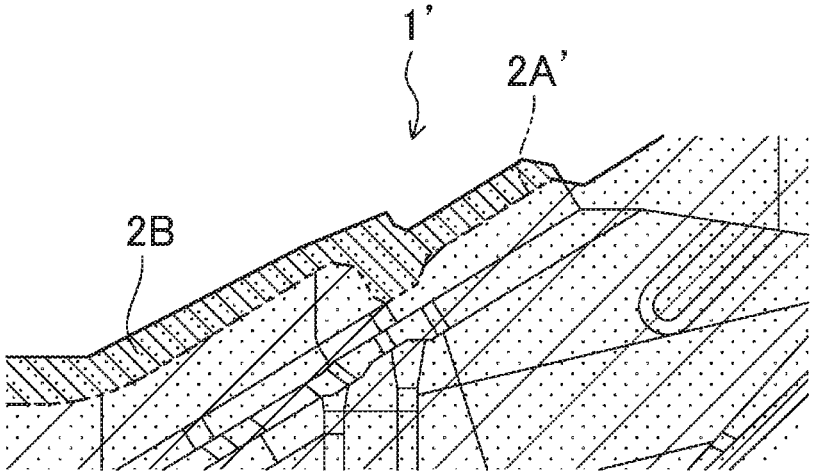
FIG. 5 is a view illustrating a flange preforming step.
Figure 6:
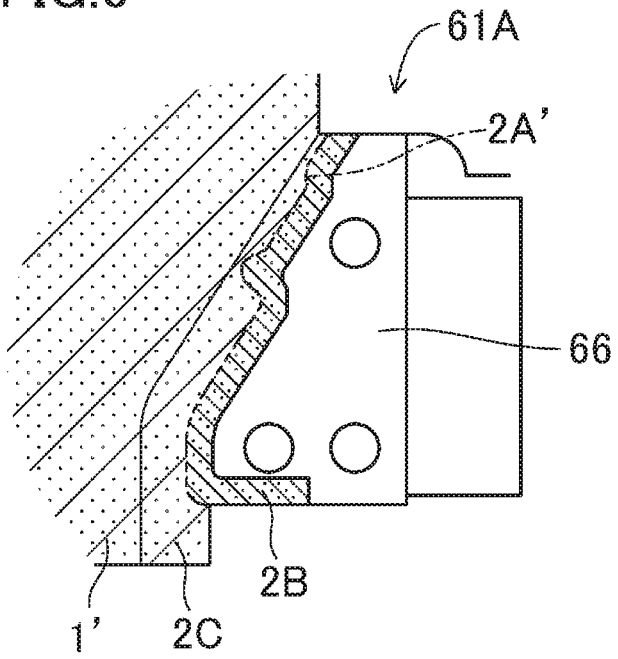
FIG. 6 is a plan view schematically illustrating a portion of an upper mold used in the flange preforming step.
Figure 7:
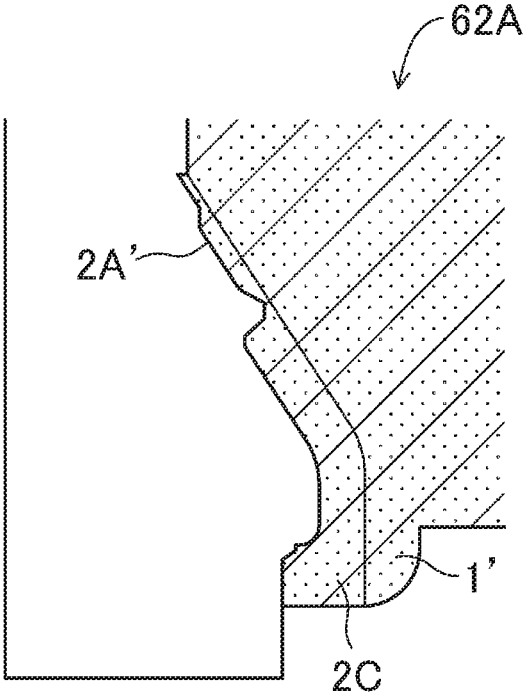
FIG. 7 is a plan view schematically illustrating a portion of a lower mold used in the flange preforming step.

In the flange preforming step S11, a preliminary flange 2C having a preliminary outer peripheral edge 2A', which is the outer peripheral edge 2A of the flange 2 at which the cutout portion 3 is not formed yet, is formed as shown in FIG. 5. FIGS. 6 and 7 show the first upper mold 61A (trimming element) and the first lower mold 62A (trimming element) which form the preliminary outer peripheral edge 2A'. In FIGS. 5 to 7, the workpiece 1' to be molded is hatched with oblique lines and dots. FIGS. 5 and 6 show the workpiece 1' for which the preliminary outer peripheral edge 2A' has not been provided yet. FIG. 7 shows the workpiece 1' for which the preliminary outer peripheral edge 2A' has been provided.

As shown in FIGS. 6 and 7, a pressing portion 66 (prepressing mold) presses the workpiece 1' sandwiched between the first upper mold 61A and the first lower mold 62A from above to cut an end portion 2B off, thereby forming the preliminary flange 2C having the preliminary outer peripheral edge 2A'.

The pressing portion 66 forms the preliminary flange 2C such that a portion of the flange 2, which will be the first flange portion 21, is pressed to be in a preform position 21K' which is deeper in the thickness direction of the first flange portion 21 than a final product shape position 21K.

Figure 8:
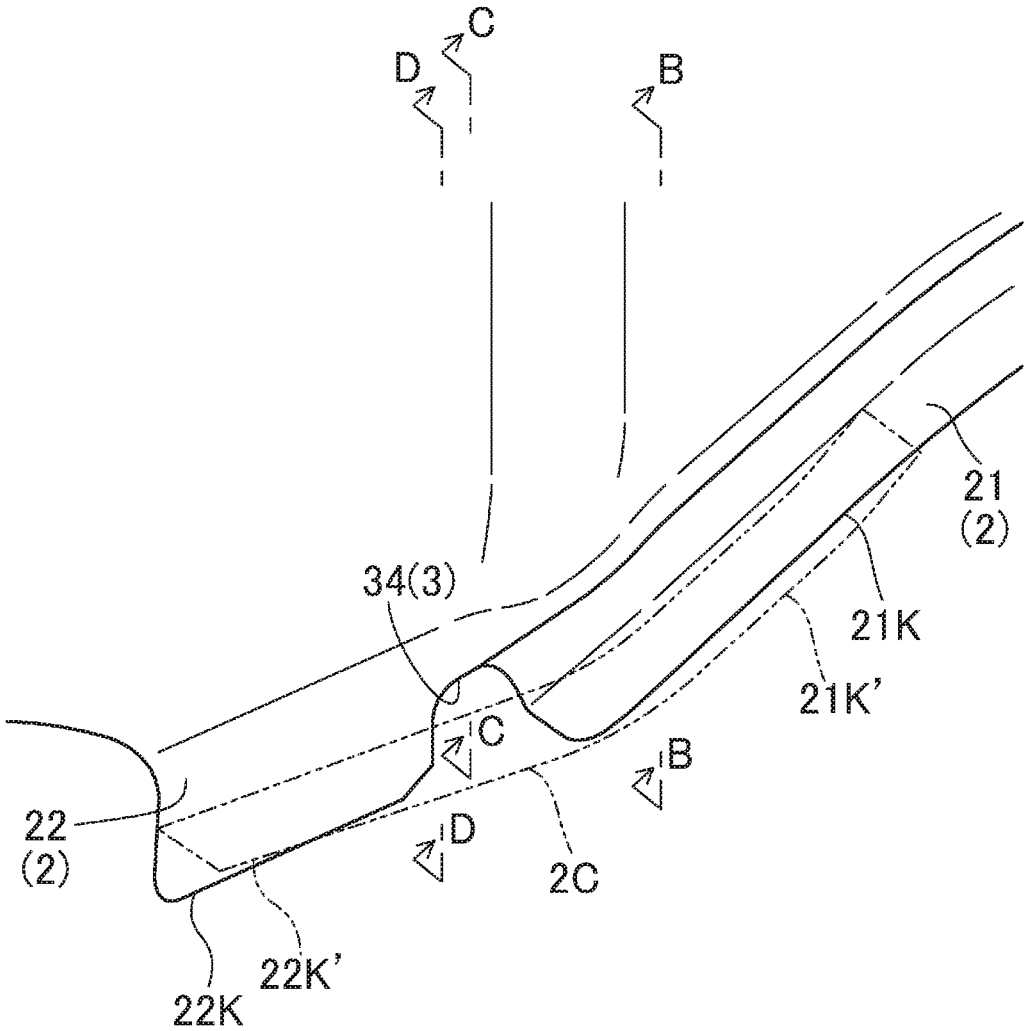
FIG. 8 is a diagram illustrating a preform position compared with a final product shape position shown in FIG. 1.
Figure 9:
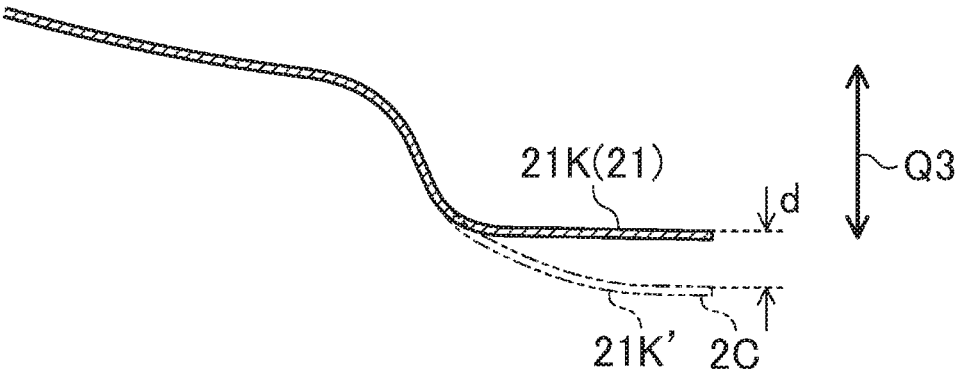
FIG. 9 is an end view taken along line B-B of FIG. 8.

Specifically, in FIG. 8, the position of the preliminary flange 2C is indicated by a virtual line together with the press-formed product 1 of FIG. 1. FIG. 9 shows an end view taken along line B-B of FIG. 8. As shown in FIGS. 8 and 9, a portion of the preliminary flange 2C which will finally be the first flange portion 21 is in a preform position 21K' which is deeper than the final product shape position 21K in the thickness direction Q3 of the first flange portion 21. As shown in FIG. 9, a distance d in the thickness direction Q3 between the final product shape position 21K and the preform position 21K' can be set, for example, not less than 1 mm and not more than 5 mm, preferably not less than 2 mm and not more than 3 mm, so as to keep the press-molded product 1 from being excessively deformed and the cutout portion 3 from cracking.

—Cutout Forming Step—

Figure 10:
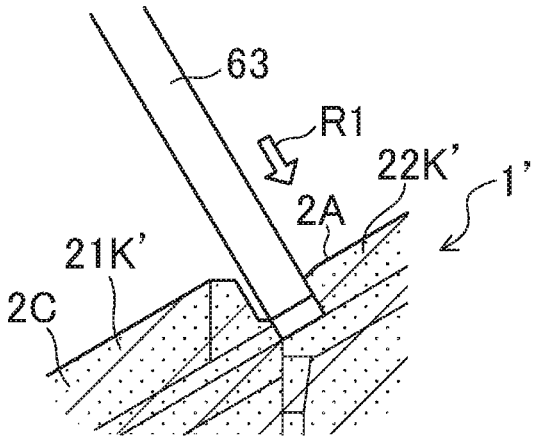
FIG. 10 is a view illustrating a cutout forming step.

Next, in the cutout forming step S12, the cutout portion 3 is formed in the workpiece 1' having the preliminary outer peripheral edge 2A'. As shown in FIG. 10, a cam member 63 for forming the cutout portion 3 slides in the direction of the arrow R1 toward the preliminary flange 2C, thereby forming the cutout portion 3.

Figure 11:
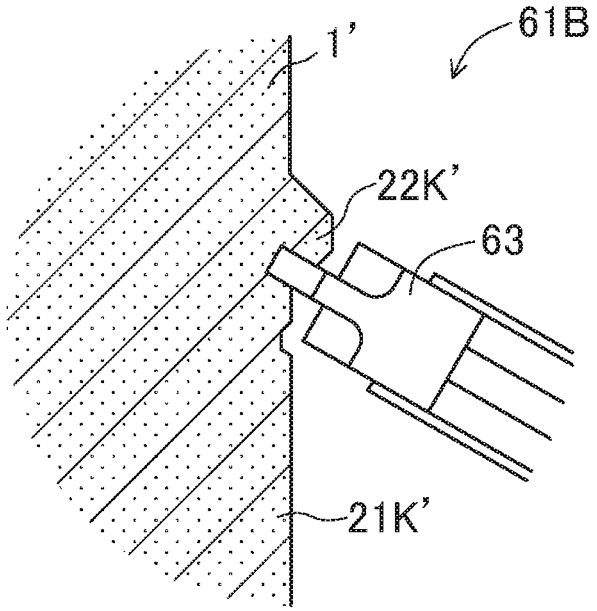
FIG. 11 is a plan view schematically illustrating a portion of an upper mold used in the cutout forming step.
Figure 12:
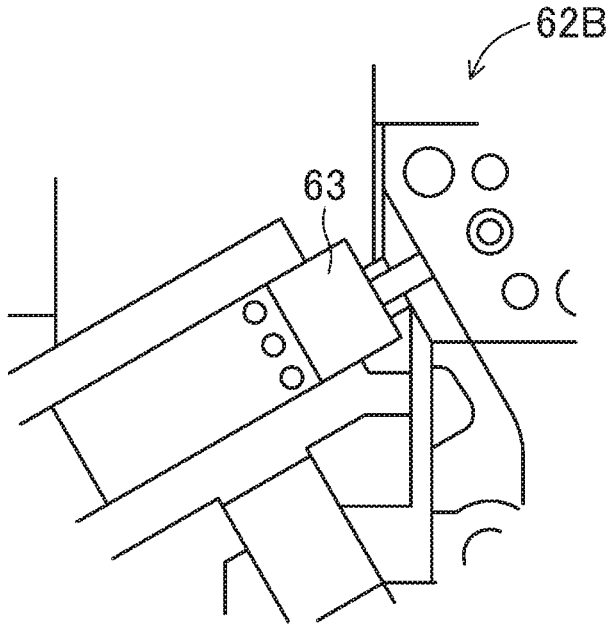
FIG. 12 is a plan view schematically illustrating a portion of a lower mold used in the cutout forming step.

Specifically, as shown in FIGS. 11 and 12, the workpiece 1' is moved toward a pressing mold including the second upper mold 61B (trimming element) and the second lower mold 62B (trimming element), so that the cutout portion 3 is formed by the cam member 63. Note that the cam member 63 is disposed between the second upper mold 61B and the second lower mold 62B, but is shown in both of FIGS. 11 and 12 for easy understanding. The workpiece 1' is shown only in FIG. 11, and is hatched with oblique lines and dots.

—Finishing Step—

In the finishing step S2, the preliminary flange 2C is molded into the final product shape position of the press-molded product 1 after the trimming step S1. As shown in FIG. 3, the finishing step S2 includes the first flange portion forming step S21 and the second flange portion forming step S22.

Specifically, to form the first flange portion 21, "return molding" of lifting the portion which will be the first flange portion 21 in the thickness direction Q3 of the first flange portion 21 from the preform position 21K' to the final product shape position 21K of the first flange portion 21 is performed as shown in FIG. 9 (first flange portion forming step S21).

Figure 14:
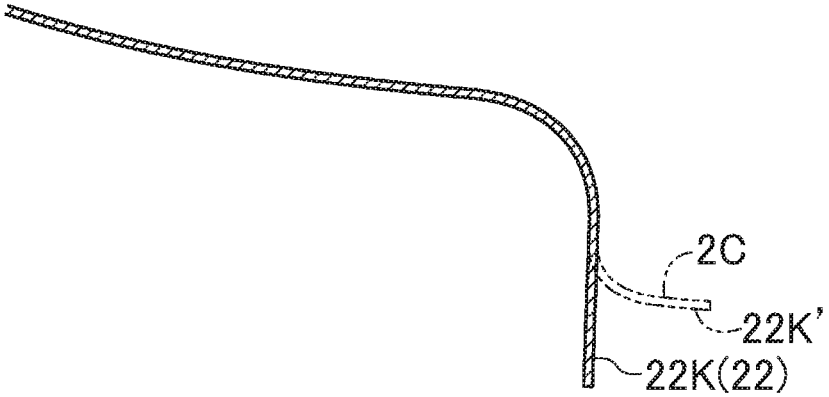
FIG. 14 is an end view taken along line D-D of FIG. 8.

To form the second flange portion 22, as shown in FIG. 14, the portion which will be the second flange portion 22 is bent from a preform position 22K' to a final product shape position 22K of the second flange portion 22 (second flange portion forming step S22).

Figure 13:
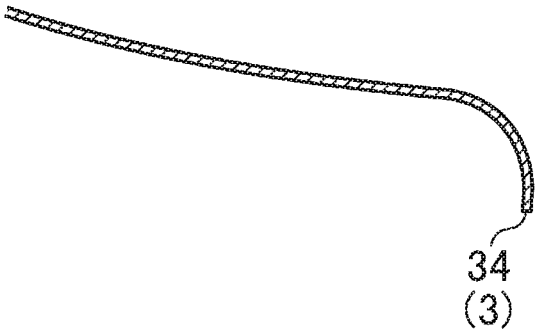
FIG. 13 is an end view taken along line C-C of FIG. 8.

Note that the bottom 34 of the cutout portion 3 does not change before and after the finishing step S2 as shown in FIG. 13. That is, the bottom 34 is formed into the final product shape in the cutout forming step S12.

Figure 15:
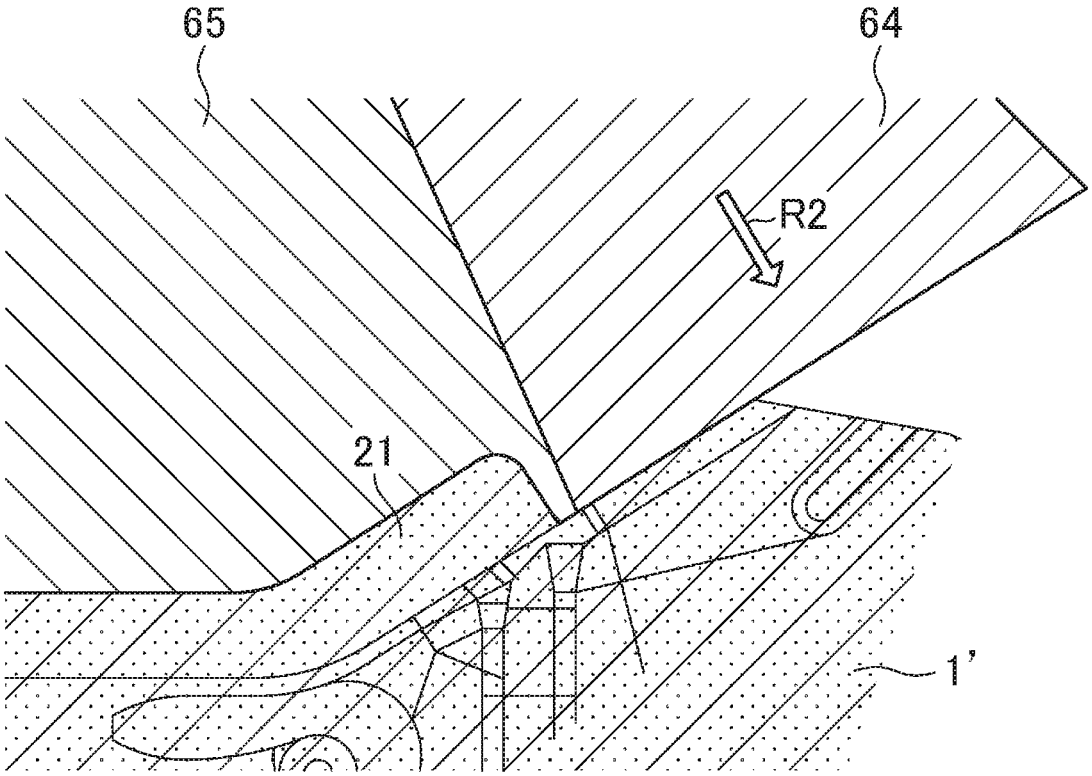
FIG. 15 is a view illustrating a finishing step.
Figure 16:
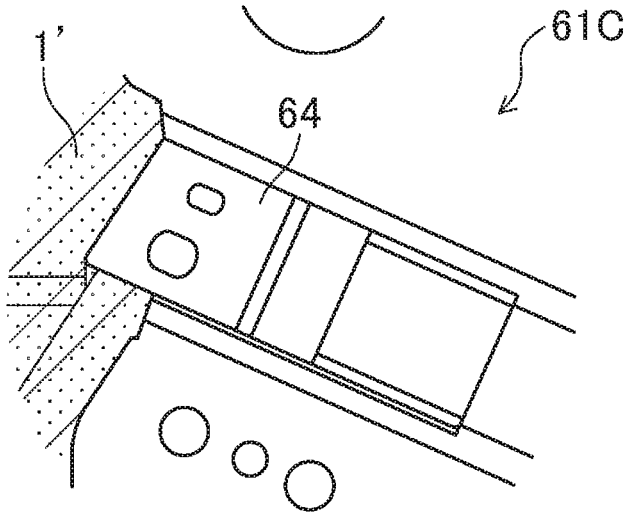
FIG. 16 is a plan view schematically illustrating a portion of an upper mold used in the finishing step.
Figure 17:
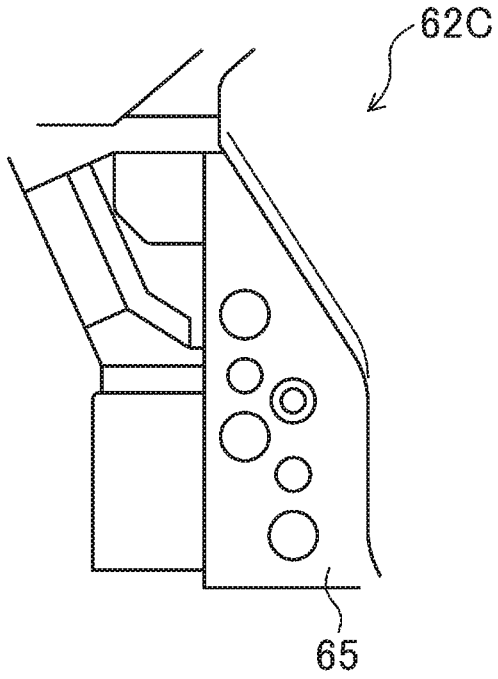
FIG. 17 is a plan view schematically illustrating a portion of a lower mold used in the finishing step.

FIGS. 15 to 17 schematically show the pressing mold used in the finishing step S2. Specifically, as shown in FIGS. 16 and 17, the finishing step S2 is performed using the third upper mold 61C (finishing element) and the third lower mold 62C (finishing element). The third lower mold 62C is provided with a pressing portion 65 (final pressing mold) for performing the return molding in the first flange portion molding step S21. Further, a bending cam member 64 for performing the bending in the second flange portion forming step S22 is provided between the third upper mold 61C and the third lower mold 62C. In FIGS. 15 and 16, the workpiece 1' is hatched with oblique lines and dots. As shown in FIG. 15, the pressing portion 65 slides in the direction coming out of the paper surface of FIG. 15 to perform the return molding for forming the first flange portion 21. The cam member 64 slides in the direction of an arrow R2 to perform the bending for forming the second flange portion 22.

Figure 18:
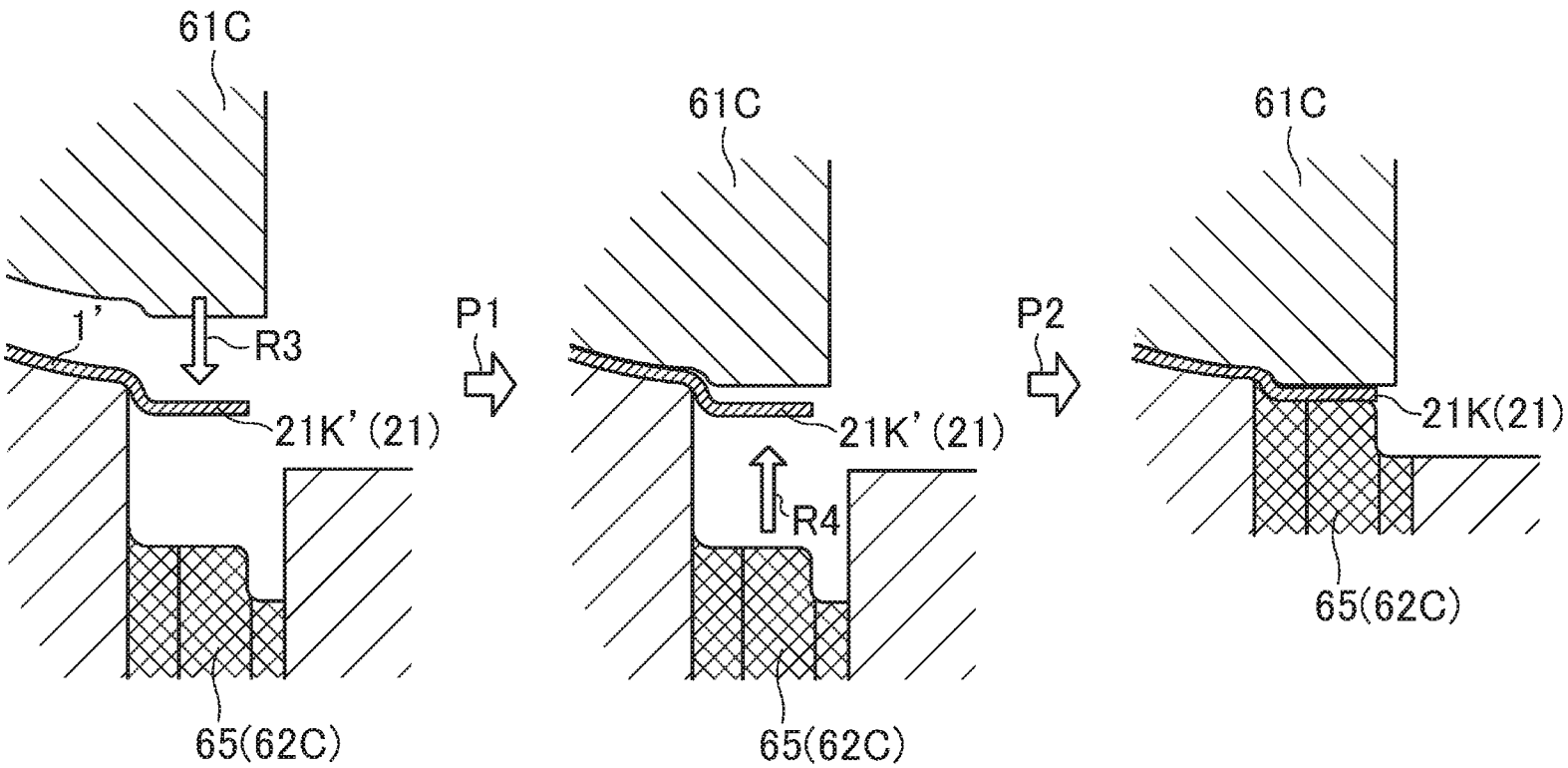
FIG. 18 is a view illustrating a first flange portion forming step.

FIG. 18 shows how the first flange portion forming step S21 is performed. In a first stage shown in the left part of FIG. 18, the third upper mold 61C is lowered toward the workpiece 1' on the molding surface of the third lower mold 62C to be positioned above the workpiece 1'. In this first stage, the molding surface of the third upper mold 61C is spaced from the first flange portion 21 in the preform position 21K'. Then, in a second stage shown in the center part of FIG. 18, the pressing portion 65 of the third lower mold 62C slides in the direction of an arrow R4. Thereafter, in a third stage shown in the right part of FIG. 18, the pressing portion 65 pushes the first flange portion 21 in the preform position 21K' from below in the direction of an arrow P2. As a result, the first flange portion 21 is molded into the final product shape position 21K between the pressing portion 65 and the third upper mold 61C.

In the second flange portion forming step S22, the pressing portion 65 is used to bend the second flange portion 22 in the preform position 22K' as shown in FIGS. 14 to 16. In this way, the second flange portion 22 is molded into the final product shape position 22K. At this time, as shown in FIG. 2, the pressing portion 65 performs the bending of the second flange portion 22 such that the predetermined angle θ is formed between the extending direction Q21 of the first flange portion 21 and the extending direction Q22 of the second flange portion 22.

As described above, the press-molded product 1 is formed into the final product shape.

In the finishing step S2, the return molding for forming the first flange portion 21 (the first flange portion forming step S21) and the bending for forming the second flange portion 22 (the second flange portion forming step S22) are performed in the same molds, namely, the third upper mold 61C and the third lower mold 62C. This can simplify the finishing step S2, and hence the press molding method, and can contribute to the downsizing of the press molding apparatus 6. In this embodiment, the return molding for forming the first flange portion 21 is performed first, and then the bending for forming the second flange portion 22 is performed. However, the return molding and the bending may be performed in a reverse order. Alternatively, the return molding for forming the first flange portion 21 and the bending for forming the second flange portion 22 may be performed using different molds.

<Advantages>

According to the press molding method of the present embodiment described above, the first flange portion 21 is press-molded into the preform position 21K' deeper than the final product shape position 21K of the first flange portion 21 as shown in FIG. 9 in the flange preforming step S11, and then the first flange portion 21 is molded into the final product shape position 21K in the first flange portion forming step S21. Advantages of this feature will be described below.

Figure 19:
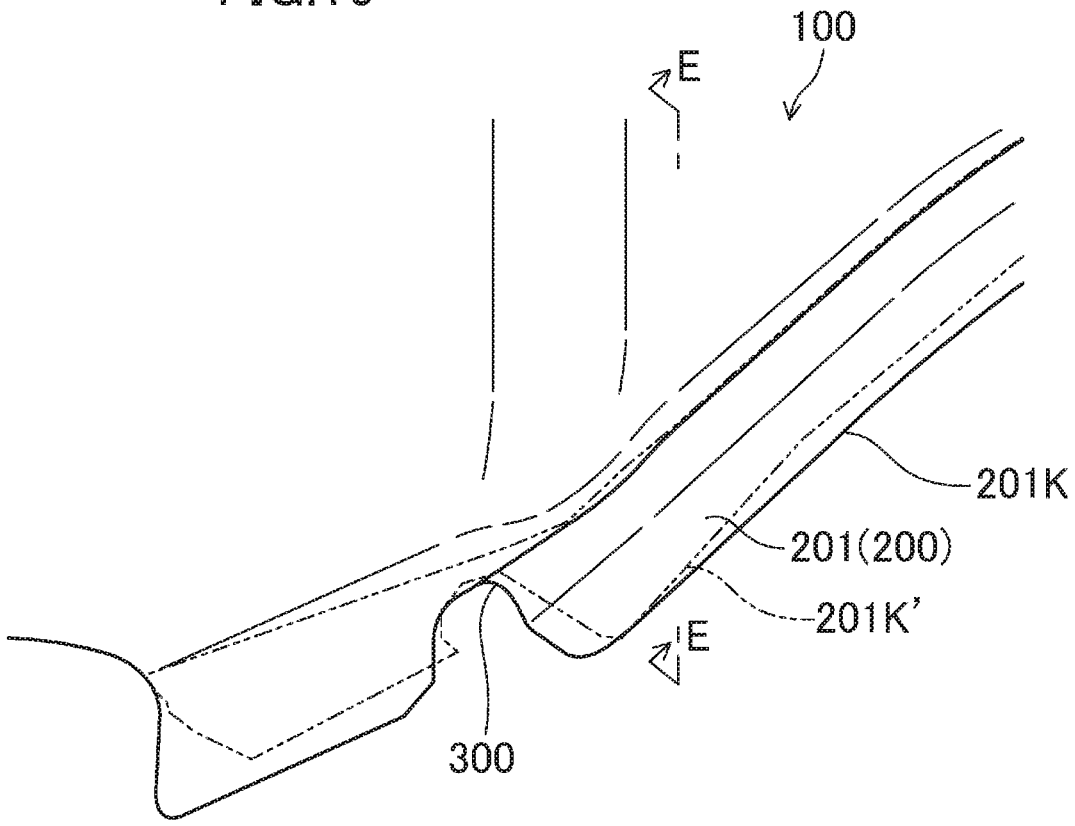
FIG. 19 is a view illustrating a conventional press molding method.
Figure 20:
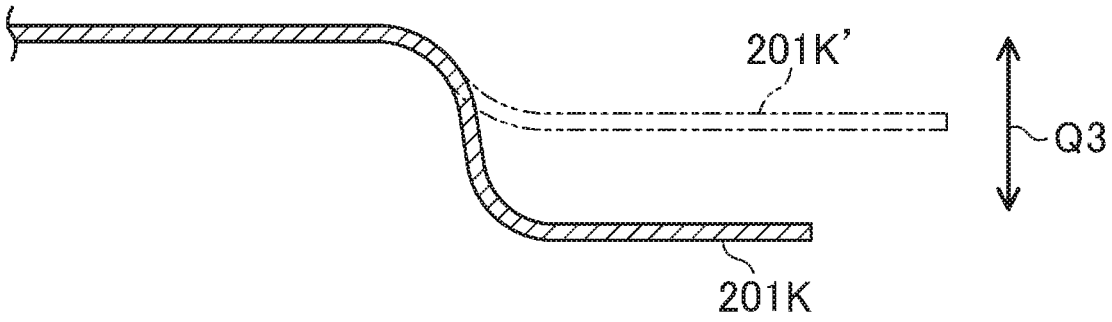
FIG. 20 is an end view taken along line E-E of FIG. 19.

FIGS. 19 and 20 show a conventional press molding method. In FIGS. 19 and 20, a virtual line indicates the shape of a press-molded product 100 after the trimming step, and a solid line indicates the final product shape of the press-molded product 100 after the finishing step. As shown in FIGS. 19 and 20, when the trimming step is performed to determine an outer peripheral edge of a flange 200 and form a cutout portion 300, for example, it is assumed that a first flange portion 201 is in a preform position 201K' shallower in the thickness direction Q3 of the first flange portion 201 than a final product shape position 201K. Thereafter, when the first flange portion 201 is deeply press-molded into the final product shape position 201K in the finishing step, a pressing force is applied to the first flange portion 201 in the direction in which the first flange portion 201 extends, and a tensile force is generated in the vicinity of the cutout portion 300. This may possibly cause a crack in the vicinity of the cutout portion 300.

In contrast, according to the press molding method of the present embodiment, a pressing force is applied in a direction in which the first flange portion 21 is compressed in the finishing step S2. In this case, even when the first and second flange portions 21 and 22 are twisted with respect to each other so that the predetermined angle θ is formed between the extending direction Q21 of the first flange portion 21 and the extending direction Q22 of the second flange portion 22, just like in the press-molded product 1 of this embodiment, the occurrence of a tensile force in the vicinity of the cutout portion 3 can be reduced. This can reduce the occurrence of cracking in the vicinity of the cutout portion 3, and can improve the moldability of the press-molded product 1.

Other Embodiments

Other embodiments of the present disclosure will be described in detail below. In the following descriptions, like reference characters designate identical components in the drawings, and description of components designated by like reference characters may not be repeated.

In the first embodiment, the extending direction Q21 of the first flange portion 21 and the extending direction Q22 of the second flange portion 22 differ from each other, and the predetermined angle θ is formed therebetween. However, this is not limiting, and the predetermined angle θ may not be formed between them. Further, in the first embodiment, the special-shaped portion is the cutout portion 3. However, the special-shaped portion is not limited to the cutout, and may be a curved portion, or a hole such as a circular hole, an oval hole, and a rectangular hole, or may have protrusions and depressions.

The present disclosure can advantageously provide a press molding method and a press molding apparatus capable of reducing the occurrence of cracking of a special-shaped portion and improving moldability of a press-molded product even in the case where the special-shaped portion is formed in a flange of the press molded product.

What is claimed is:

1. A method of forming a press-molded product having a flange including a special-shaped portion, the method comprising:

a trimming step of forming an outer peripheral edge of the flange and the special-shaped portion; and a finishing step of molding the flange into a final product shape position of the press-molded product after the trimming step, wherein the flange includes a first flange portion including at least a portion of an outer peripheral edge of the special-shaped portion, in the trimming step, the first flange portion is press-molded into a preform position deeper in a thickness direction than a final product shape position of the first flange portion, and in the finishing step, performing return molding of lifting the first flange portion in the thickness direction of the first flange portion to the final product shape position of the first flange portion.

2. The method of claim 1, wherein the special-shaped portion is a cutout portion having an opening at the outer peripheral edge of the flange, the flange includes the first flange portion including a portion of an outer peripheral edge of the cutout portion, and a second flange portion including another portion of the outer peripheral edge of the cutout portion, and the press-molded product in the final product shape has the first flange portion and the second flange portion extending in different directions.

3. The method of claim 2, wherein in the finishing step, performing bending of the second flange portion so that a predetermined angle is formed between the extending direction of the first flange portion and the extending direction of the second flange portion.

4. The method of claim 3, wherein in the finishing step, performing the return molding and the bending in a same mold.

* * * * *